US006796825B2

(12) United States Patent
Wang

(10) Patent No.: US 6,796,825 B2
(45) Date of Patent: Sep. 28, 2004

(54) ELECTRICAL CONNECTOR FOR ATTACHING A CIRCUIT BOARD

(75) Inventor: Mei-Hui Wang, Hsinchu (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/271,784

(22) Filed: Oct. 17, 2002

(65) Prior Publication Data

US 2004/0077218 A1 Apr. 22, 2004

(51) Int. Cl.[7] ..... H01R 13/62
(52) U.S. Cl. ..... 439/326
(58) Field of Search ..... 439/64, 326, 328, 439/570

(56) References Cited

U.S. PATENT DOCUMENTS 6,027,357 A * 2/2000 Howell et al. ..... 439/326
6,042,411 A * 3/2000 Choy ..... 439/328
6,146,177 A * 11/2000 Wu ..... 439/326
6,413,109 B1 * 7/2002 Kobayashi et al. ..... 439/326
6,517,378 B2 * 2/2003 Fumikura ..... 439/570

* cited by examiner

*Primary Examiner*—Javaid H. Nasri
*Assistant Examiner*—Thanh-Tam Le
(74) *Attorney, Agent, or Firm*—Birch, Stewart, Kolasch & Birch, LLP

(57) ABSTRACT

A structure of a connector for attaching a circuit board is disclosed. The connector comprises a housing composed of an insulation material, a socket and two buckling elements detachably attached to two ends of the socket. The socket comprises a groove in a central region for receiving a circuit board, and a row of signal contacts within the groove for attaching and electrically connecting with the circuit board. At two ends of the groove side comprise two buckling arms. The circuit board inserted into the groove and pressed in between the buckling arms, and making the contact points of the circuit board to come in electrical contact with signal contacts inside of groove of the socket.

13 Claims, 12 Drawing Sheets

ELECTRICAL CONNECTOR FOR ATTACHING A CIRCUIT BOARD

BACKGROUND OF THE INVENTION

1. Filed of the Invention

The present invention relates to an electrical connector, and more particularly to an electrical connector arrangement having a covering element and a joint portion, wherein the joint portion can be engaged with the covering element to form a floating adjustment space there-between so that any height difference within the electrical connector assembly parts due to welding can be effectively compensated.

2. Description of the Related Art

Due to the rapid advancement in computer and information technologies, nowadays desktop and notebook computers are very popular. Further, the need for smaller, thinner and compact, and faster electronic devices are greatly demanded in the present market. Electrical connectors are connected to a variety of circuit board, for example a memory chip module, for saving, transmitting and/or retrieving electronic data signals. Accordingly, smaller and compact connectors in computers are highly desirable meeting the market demand. The connectors in computers usually welded to the motherboard or interface card using a SMT (surface mounting technology), in this manner that there is no need to drill a hole for fitting signal contacts, thus a space occupation on the circuit board can be reduced. However, when a height difference during the welding phase or welding point formed while welding an adaptor using SMT is over the allowed range occurs, it causes biasing of the connector thus a reliable connection between the connector and the circuit board cannot be achieved.

Referring to FIG. 15, illustrates a conventional socket A comprising a plurality of signal contacts A2 within a groove A1 formed which is disposed in a central region of the socket A, and on each ends of the socket A comprises a slot A3. A latching element B is slid into the slot A3 in order to detachably attach to the socket A. The latching element B comprises a positioning element B1 and a resilient element B2. The positioning arm B1 comprises a welding portion B11 disposed at a bottom edge, bent inwardly. The signal contacts A2 of the socket A, and the welding portion B11 of the latching element B are welded onto the predetermined positions. Nevertheless, assembly of the above-mentioned socket A and the latching elements B, a height difference between three contact points, namely, the signal contacts A2 and the two welding portions B11, with respect to a horizontal plane will invariably occur. The height difference allows only two contact points to come in contact with a circuit board, and the third contact point is raised in an upper position. Therefore, good connectivity cannot be achieved by using tin solution in the general welding process because the tin solution does not have a good extensity. Thus, a space formed at the welding point between the raised contact and the circuit board cannot be filled up using the tin solution in order to electrically connect the circuit board to a raised contact point. As a result this causes defects of the device and thus the reliability of the device is poor. Furthermore, when the memory chip module is obliquely pushed into the inner groove A1 of the socket A, the inner groove A1 is used as an axis to press the memory chip module downwardly, as a result, the edge of the memory chip module directly presses against the bulking block B21 which is positioned on an inner side of the resilient arms B2 attached to two sides of the latching element B, to securely buckle the edge of the memory chip module buckling to the base side surface of buckling block B21. Although this design can buckle the memory chip module, however as the memory chip module is forced in between the resilient arms B2, the resilient arms B2 presses against the sides of the memory chip module due to the inertial property and the plastic material which causes the resilient arms B2 to bend inwardly, while a bottom face of the memory chip module directly presses against the buckling block B21. Accordingly, the space available for memory chip module to buckle on to buckling block B21 of resilient arm B2 is small and therefore the fitting of the memory chip module between the two resilient arms B2 is poor. When the memory chip module is shaken due to some external force, for example during maintenance, the memory chip module will easily come loose from the latching element B and get disconnected from the socket A.

Further, when the size of the buckling block B21 of the resilient arms B2 of the latching element B is enlarged in an attempt to secure buckling of the memory chip module, as the memory chip module is pressed downwardly against the buckling block B21, the two resilient arms B2 will be forced outwardly or downwardly causing fracture or even break the resilient arms B2.

SUMMARY OF THE INVENTION

Accordingly, in the view of the foregoing, the present inventor makes a detailed study of related art to evaluate and consider, and uses years of accumulated experience in this field, and through several experiments, to create a new electrical connector for attaching a circuit board of the present invention. The present invention provides an innovated electrical connector for providing reliable electrical connections between the circuit board and the connector using SMT and for fastening or releasing a circuit board, which can effectively prevent the circuit board from coming loose and disconnected from the electrical connector by an unwanted external force.

Accordingly, an object of the present invention is to provide an electrical connector arrangement for providing reliable electrical connections between a circuit board and the connector using SMT.

Another object of the present invention is to provide an electrical connector having arrangement that allows the buckling arm of the electrical connector to move up and down within a floating adjustment space, thus a height difference between the socket and buckling arm due to welding can be effectively compensated.

Another object of the present invention is to provide an electrical connector having two resilient arms with sufficient buckling space for securely buckling a circuit board and to provide a proper electrical connection between the electrical connector and the circuit board.

Another object of the present invention is to provide an electrical connector having two resilient arms with sufficient buckling space for securely buckling a circuit board and effectively preventing the circuit board from coming loose and disconnected from the electrical connector by an unwanted external force.

In order to achieve the above objects and other advantages of the present invention, a connector for connecting a circuit of the present invention comprises a housing composed of an insulation material, a socket and two buckling arms detachably attached to two ends of the socket. The socket comprises a groove in a central region, and a row of signal contacts within the groove for attaching and electrically connecting with the circuit board. At two ends of the socket comprise two buckling elements. Each of the buckling elements comprises a buckling groove on a groove side and positioned adjacent to the groove. The socket is constructed from an insulation material. Each of the buckling arms comprises an insertion portion for engaging with each of the buckling groove of the socket, a plurality of gears disposed at a bottom edge of the insertion portion. A resilient arm and a base plate extend along the same direction from the insertion portion. The resilient arm comprises an arch-shaped structure biasing inwardly on a side and a securing element extending downwardly. The securing element comprises a pad clamps inwardly around two sides of the securing element. A distal end of the base plate comprises a positioning element folded inwardly. A lower edge of the base comprises a joint portion bent inwardly fitted having a hook buckling groove on its two opposite sides. A covering element comprising a fitting space with a buckling hook disposed extendedly on two opposite sides of the fitting space, and a through hole is disposed on a surface of a bottom of the covering element.

According to an aspect of the present invention, the insertion portion of the buckling arm are inserted into the buckling grooves of the socket and securely positioned with the gears securing the insertion portion of the buckling arm within the buckling grooves and preventing from slipping out.

According to another aspect of the present invention, the covering element is engaged with the joint portion of the buckling arm by inserting the joint portion into the fitting space of covering element until the edge of the joint portion comes in contact and presses against the buckling hook of the covering element pushing the buckling hook outwardly and the buckling hook readily deforms due to its elastic property as the edge of the joint portion passes through between the buckling hook, then the buckling hook returns to its original shape due to its elastic nature and buckles the hook buckling groove of the joint portion for substantially securing into position and form a floating adjustment space within the joint portion. This arrangement of the present invention allows the use of SMT to weld the plurality of signal contacts of socket and the bottom face of the covering element onto the predetermined locations of a circuit board, because the floating adjustment space between the covering element and joint portion allows the buckling arm to move up and down within floating adjustment space, thus the height difference between the socket and buckling arm due to welding can be effectively compensated.

According to another aspect of the present invention, a circuit board, for example, a memory chip module, comprises an indentation portion on the two sides for engaging with the securing element of the buckling arm. A plurality of contact elements are disposed on a frontal end of the circuit board wherein each of the contact elements is disposed on a top side, bent to extend on a sidewall and bent to extend on a bottom side of the connecting side. The frontal end of the chip is inserted into the groove of the slot to make an electrical contact with the row of signal contacts for electronic signal transmission. The frontal end of the circuit board is obliquely inserted into the groove of the socket so that the contact elements comes in contact with the row of signal contacts of the socket. Then, using the groove as an axis, the circuit board is pressed downwardly, as a result, the edge of the circuit board is pressed against the arch-shaped structure of resilient arm pushing the resilient arms on the sides outwardly and the circuit board is inserted between the side of base and positioning element. The side of base plate secures the circuit board by pressing against the sides of the circuit board. This condition does not break or make the resilient arms lose its elasticity, the elastic property of the resilient arms allows it to be deformed and extending on the side outwardly as the circuit board is pushed over the arch-shaped structure enabling the pad of resilient arm that is clamped around the securing element for securely buckling the intention portion of the circuit board. In this condition, the securing element is positioned against positioning element of the base plate, and making the contact elements of the circuit board to come in electrical contact with signal contacts inside of groove of the slot.

According to another aspect of the present invention, an aperture is disposed on a surface of the joint portion of buckling arm. A protruded buckling protrusion, which extends inwardly, is disposed on two sides of the aperture. A guiding element is disposed at a bottom surface of the covering element. A buckling block is disposed on two sides of the frontal edge of covering element 3 forming a fitting space. The joint portion of the buckling arm is inserted into fitting space to engage the guiding element of the covering element into the aperture of the joint portion by pushing forward. In this position, the buckling protrusion of the aperture surrounds the guiding element of the covering element. Meanwhile the joint portion fits into the fitting space within the inner surface of the buckling blocks of the covering element. Thus, the covering element is securely engaged with the joint portion of the buckling arm and forms a floating adjustment space between the covering element and the joint portion. This arrangement of the present invention allows the use of SMT to weld the plurality of signal contacts of socket and the bottom face of the covering element onto the predetermined locations of a circuit board, because the floating adjustment space between the covering element and joint portion allows the buckling arm to move up and down within floating adjustment space, thus the height difference between the socket and buckling arm due to welding can be effectively compensated.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
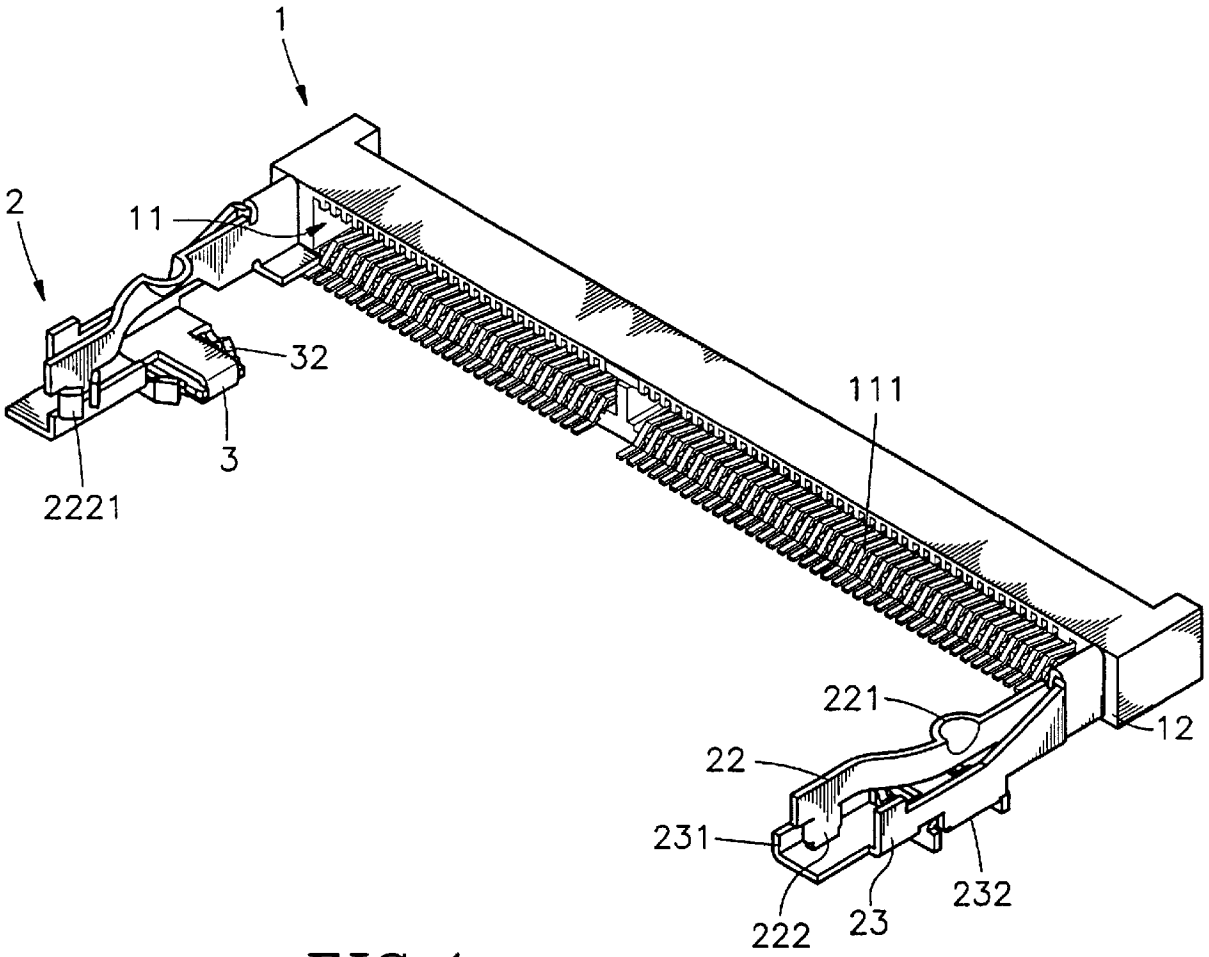
FIG. 1 is an elevational view of an electrical connector for attaching to a circuit board according to the present invention.
Figure 2:
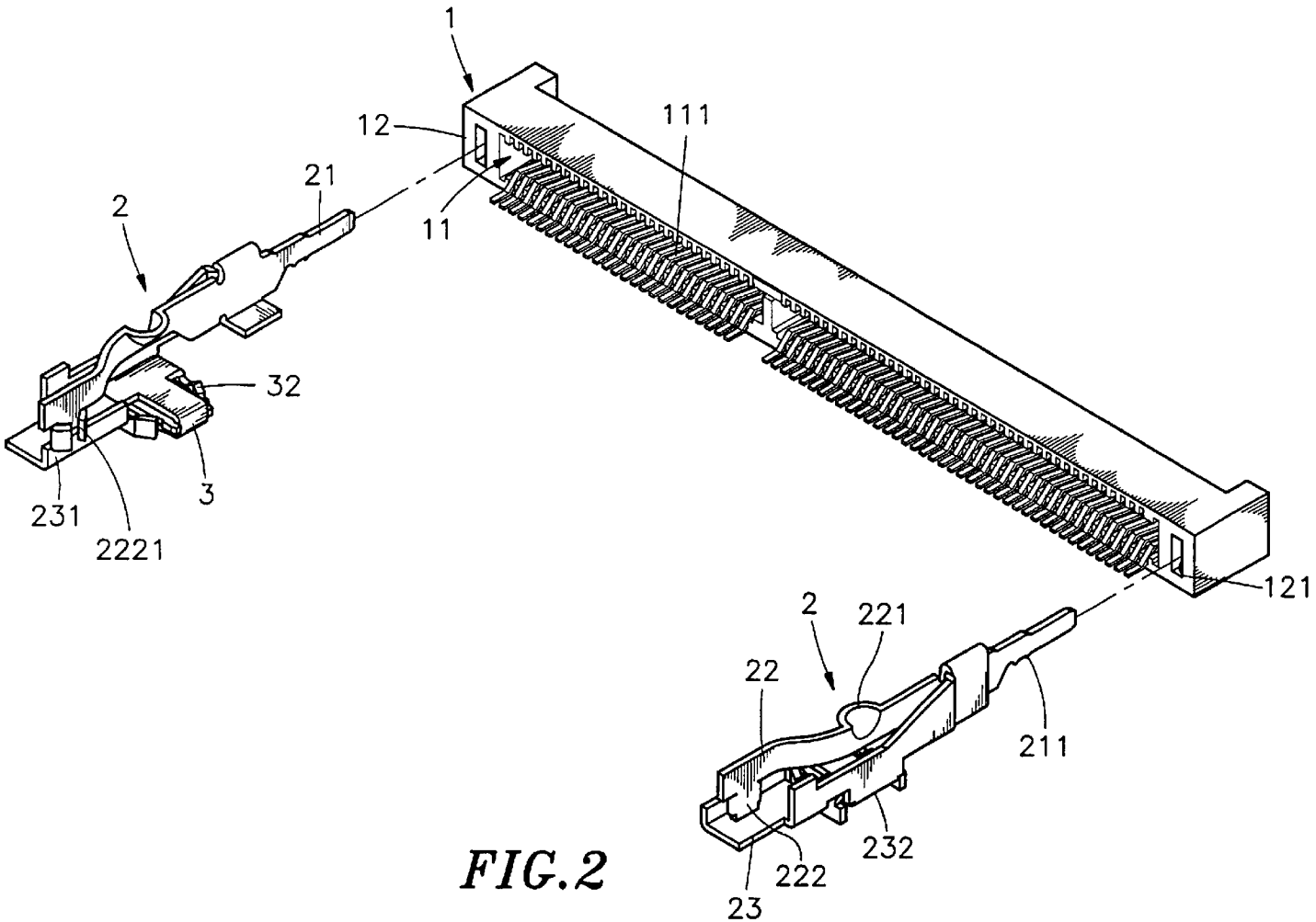
FIG. 2 is an exploded view of FIG. 1.
Figure 3:
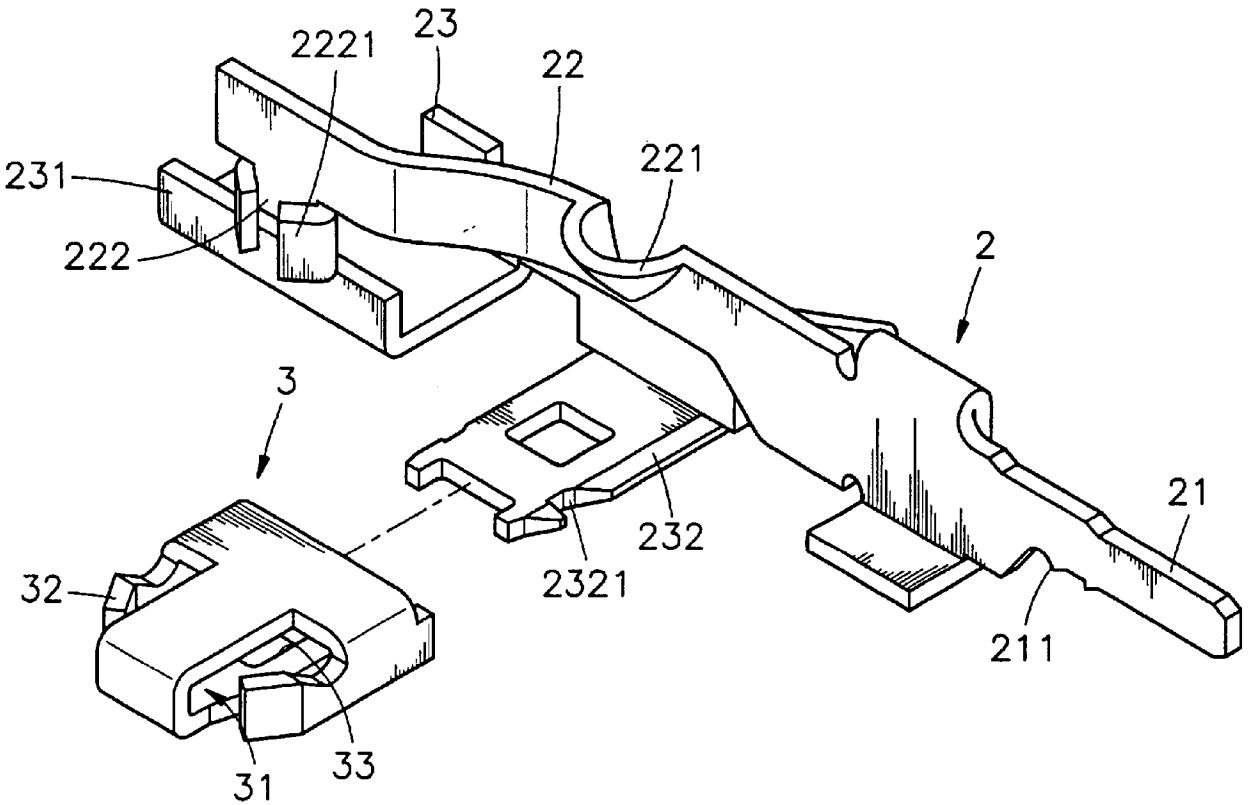
FIG. 3 is an exploded view of a buckling arm and a covering element according to the present invention.
Figure 4:
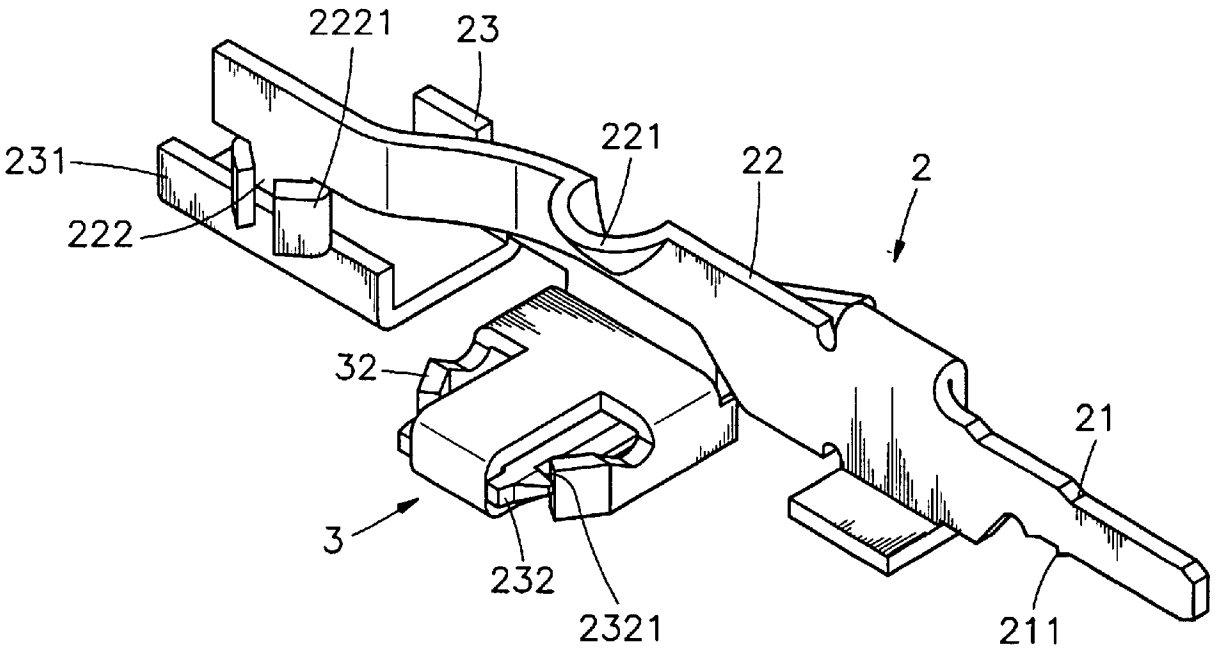
FIG. 4 is an elevational view of a buckling arm and a covering element according to the present invention.

Reference will be made in detail to the preferred embodiments of the invention, examples of which are illustrated in the accompanying drawings. Wherever possible, the same reference numbers are used in the drawings and the description to refer to the same or like parts.

Referring to FIGS. 1, 2, 3 and 4, a connector for attaching a circuit of the present invention comprises a housing composed of an insulation material, a socket 1 and two buckling arms 2 detachably attached to two ends of the socket 1.

The socket 1 comprises a groove 11 in a central region, and a row of signal contacts 111 within the groove 11 for attaching and electrically connecting with a circuit board. At two ends of the socket 1 comprise two buckling elements 12. Each of the buckling elements 12 comprises a buckling groove 121 on a groove side and positioned adjacent to the groove 11. The socket 1 is constructed from an insulation material.

Each of the buckling arms 2 comprises an insertion portion 21 for engaging with each of the buckling groove 121 of the socket 1, a plurality of gears 211 disposed at a bottom edge of the insertion portion 21. A resilient arm 22 and a base plate 23 extend along the same direction from the insertion portion 21. The resilient arm 22 comprises an arch-shaped structure biasing inwardly on a side and a securing element 222 extending downwardly. The securing element 222 comprises a pad 2221 clamps inwardly around two sides of the securing element 222. A distal end of the base plate 23 comprises a positioning element 231 folded inwardly. A lower edge of the base plate 23 comprises a joint portion 232 bent inwardly fitted having a hook buckling groove 2321 on its two opposite sides. A covering element 3 comprising a fitting space 31 with a buckling hook 32 disposed extendedly on two opposite sides of the fitting space 31, and a through hole 33 is disposed on a surface of a bottom of the covering element 3.

Figure 5:
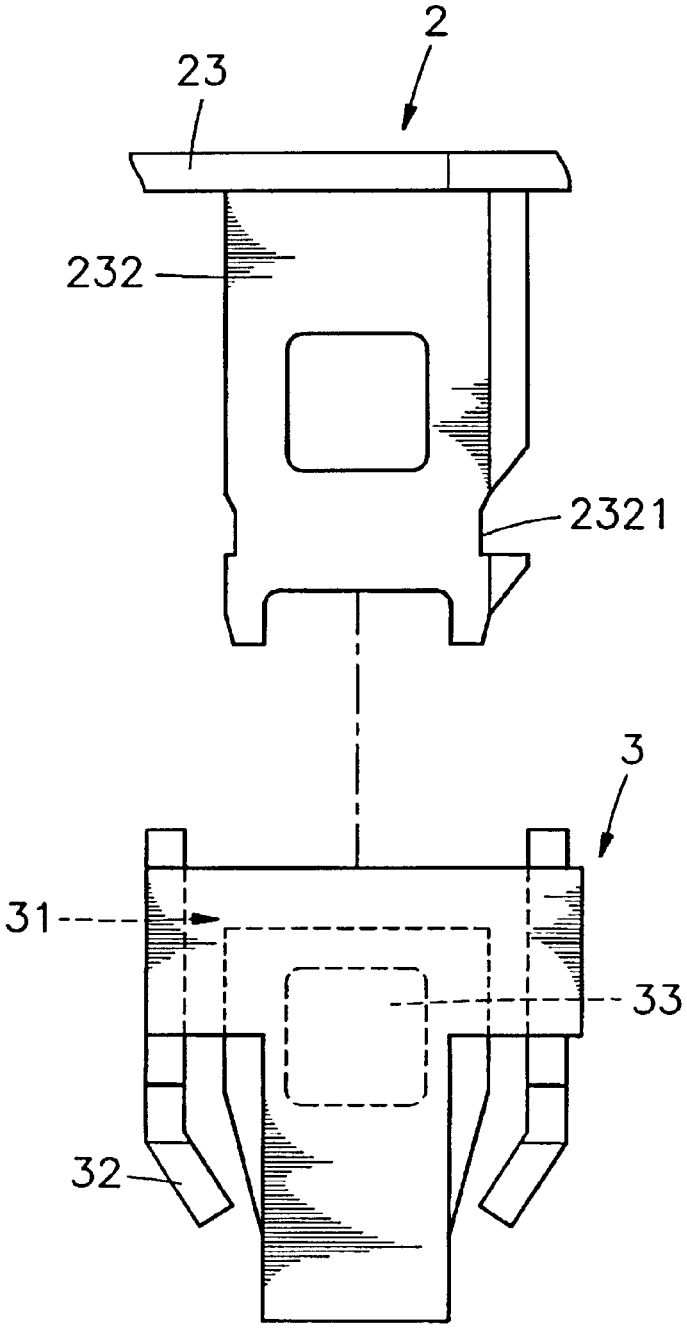
FIG. 5 is a view showing the top view before assembling the buckling arm and covering element of the present invention.
Figure 7:
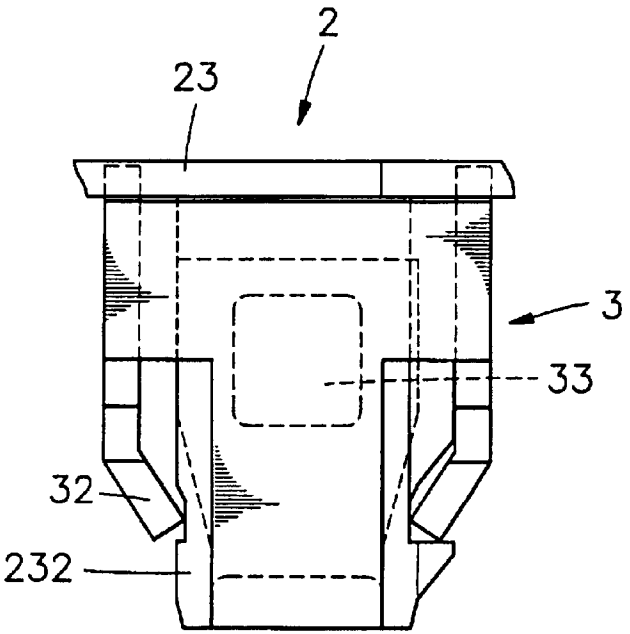
FIG. 7 is a view showing the top view after assembled the buckling arm and covering element of the present invention.
Figure 6:
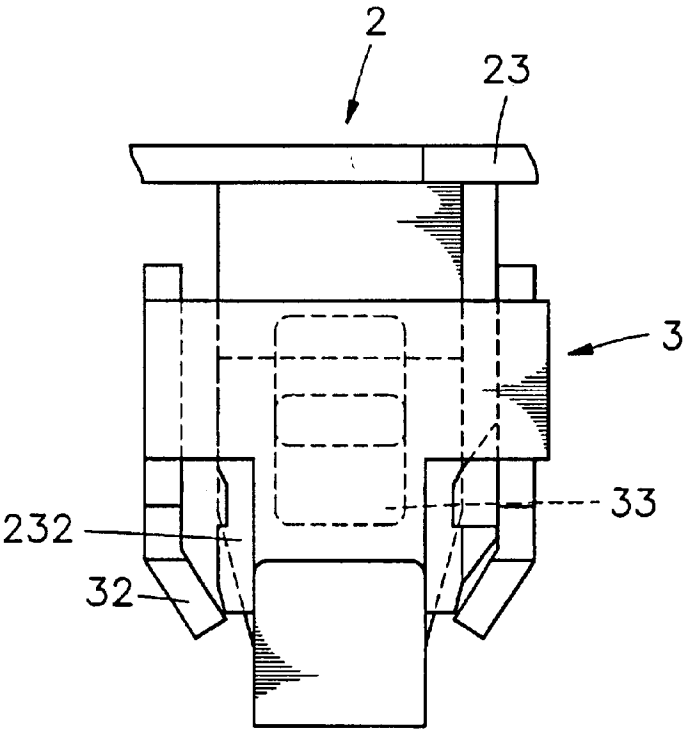
FIG. 6 is a view showing the top view while assembling the buckling arm and covering element of the present invention.
Figure 8:
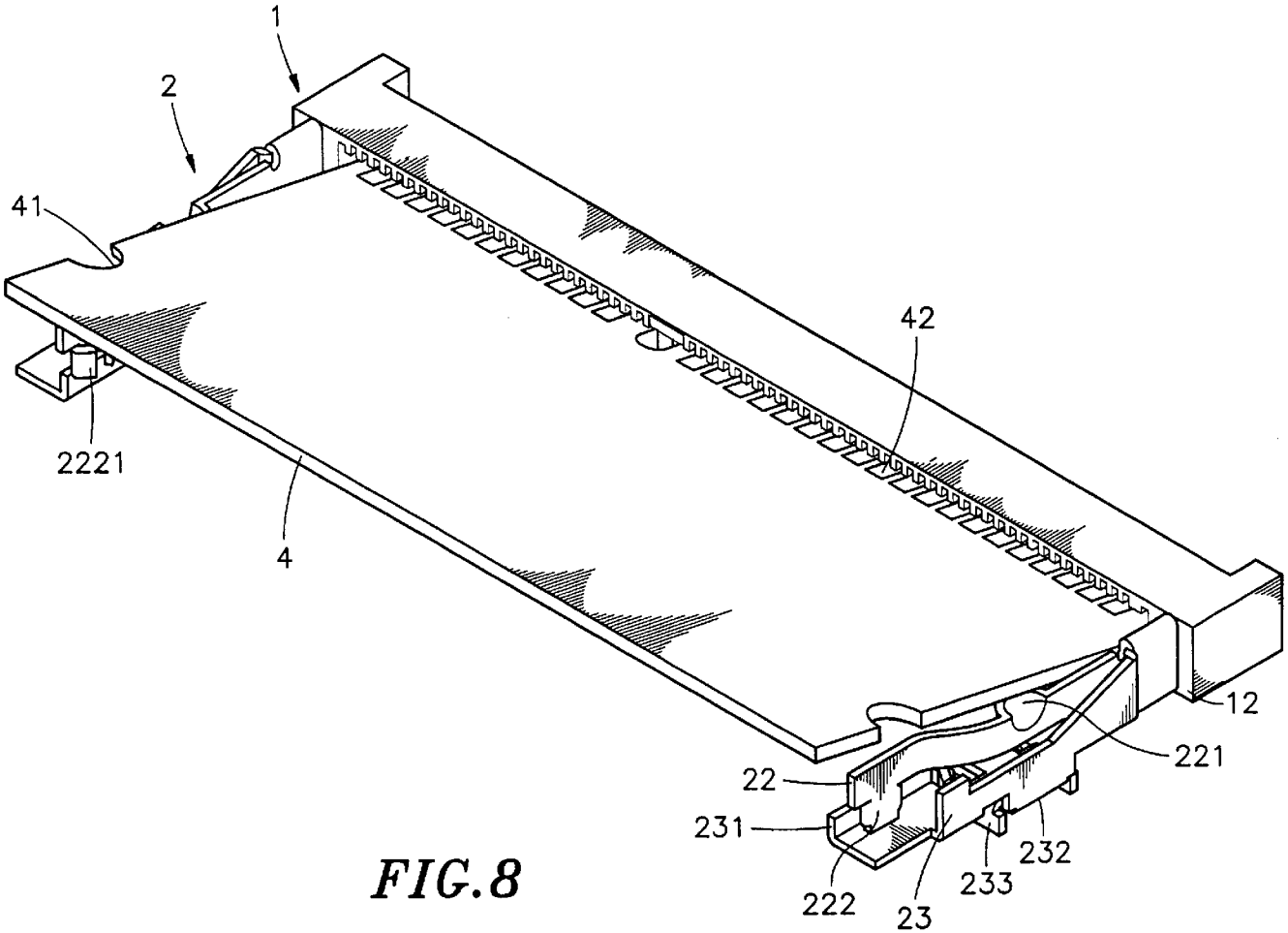
FIG. 8 is an elevational view showing insertion of the circuit board into the groove of the socket of the electrical connector according to the present invention.
Figure 9:
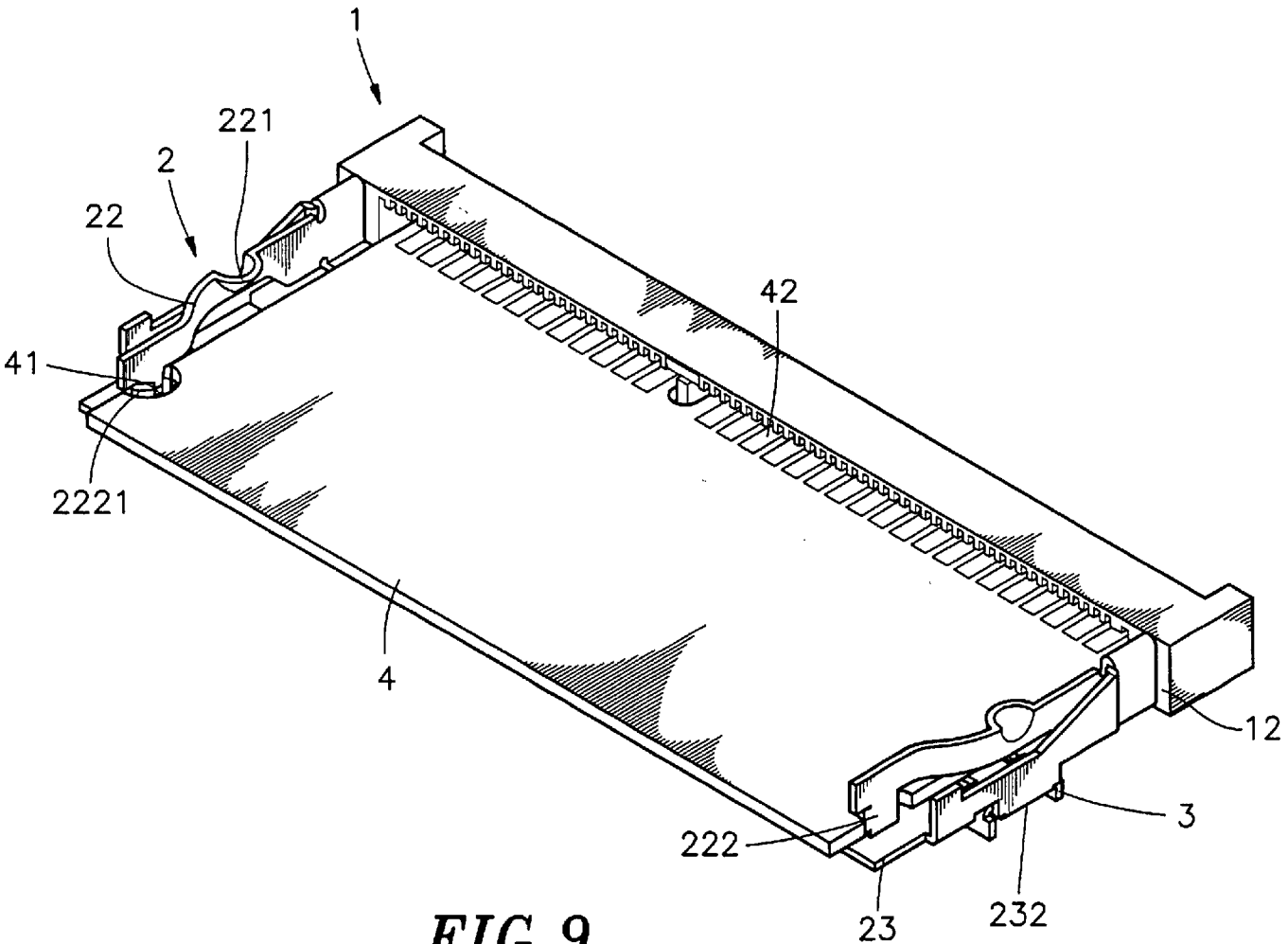
FIG. 9 is an elevational view showing after assembled the circuit board into the groove of the socket of the electrical connector of the present invention.
Figure 10:
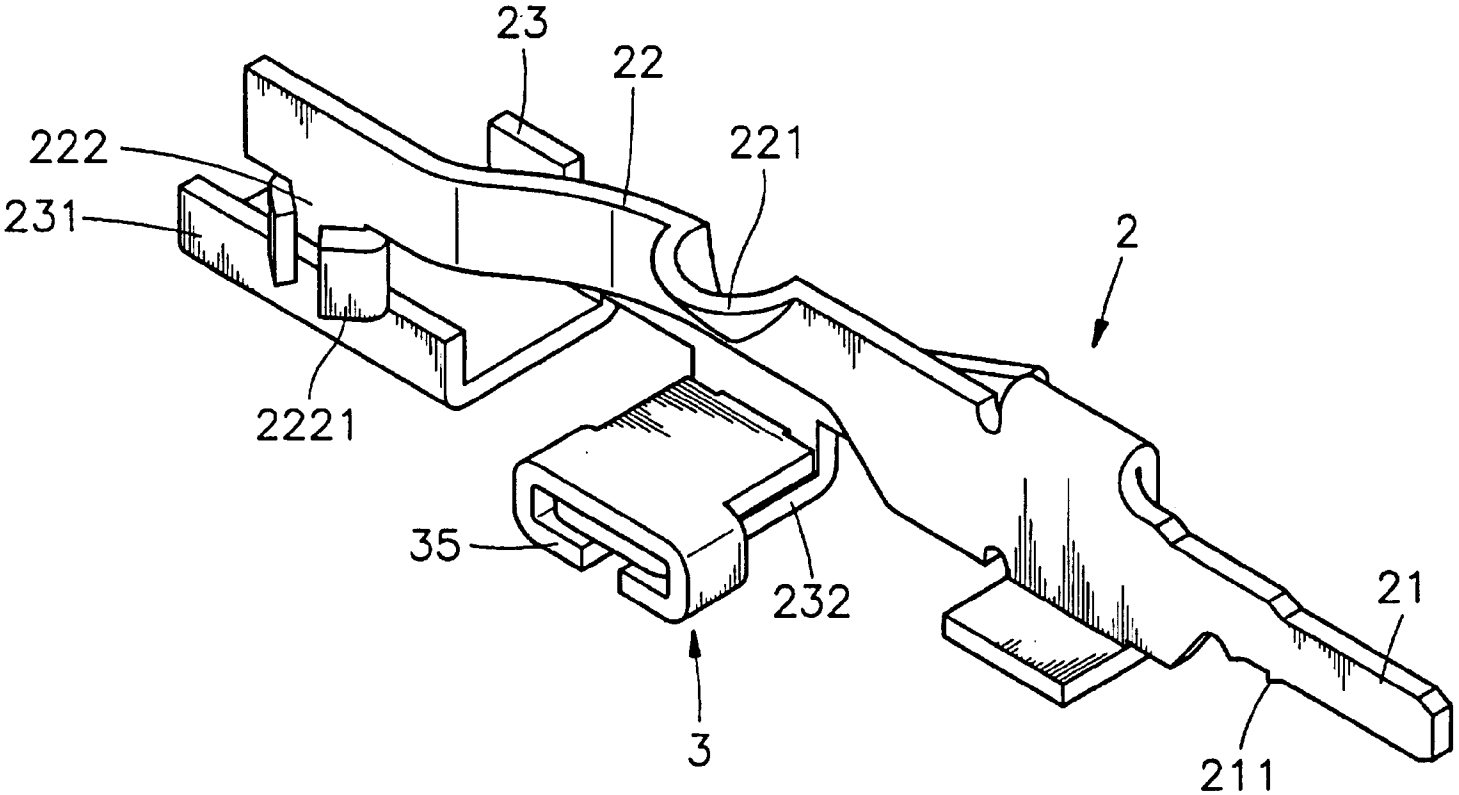
FIG. 10 is an embodiment of the buckling arm and the covering element according to another preferred embodiment of the present invention.
Figure 11:
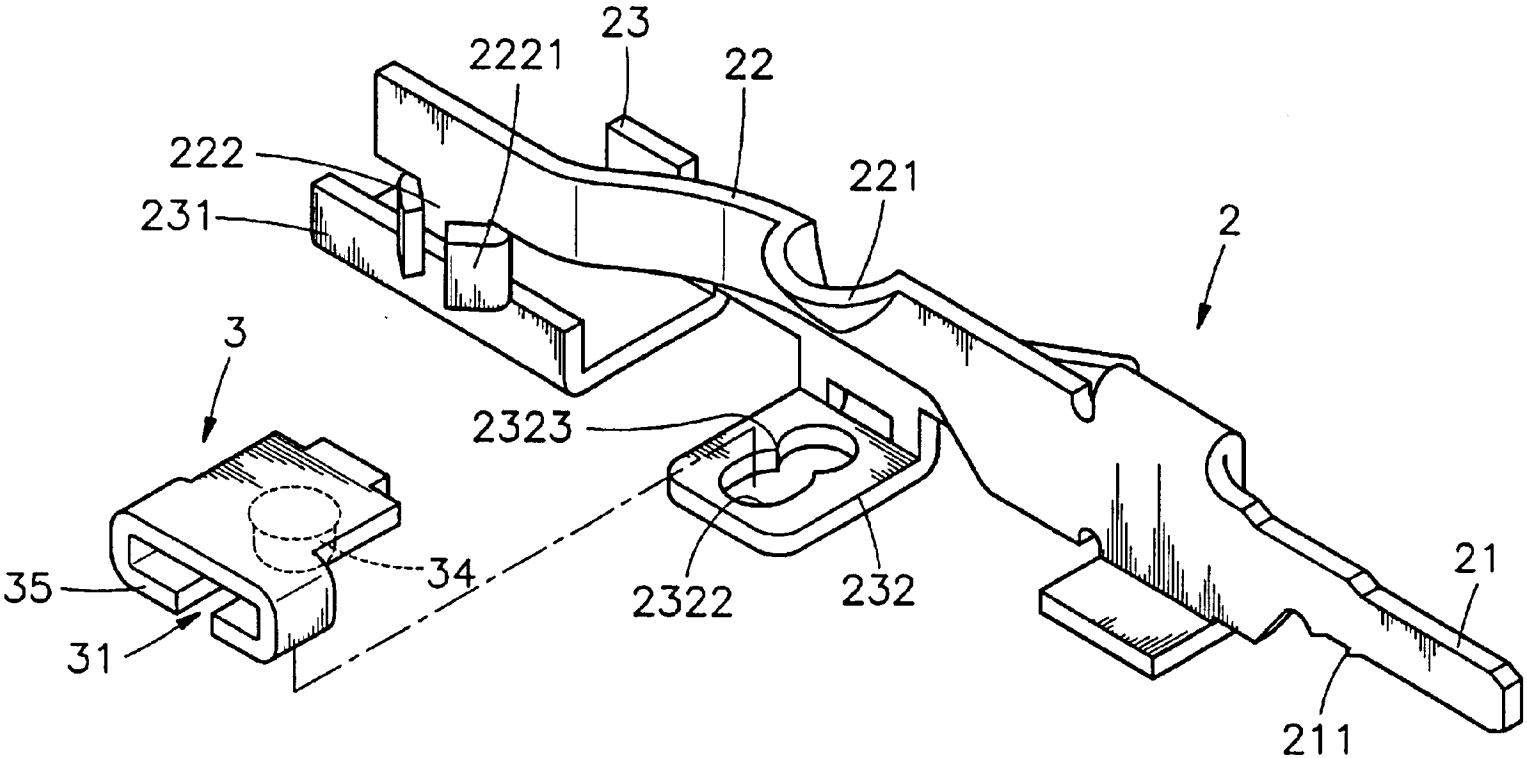
FIG. 11 is an exploded view of the buckling arm and the covering element according to another preferred embodiment of the present invention.
Figures 12, 13, 14:
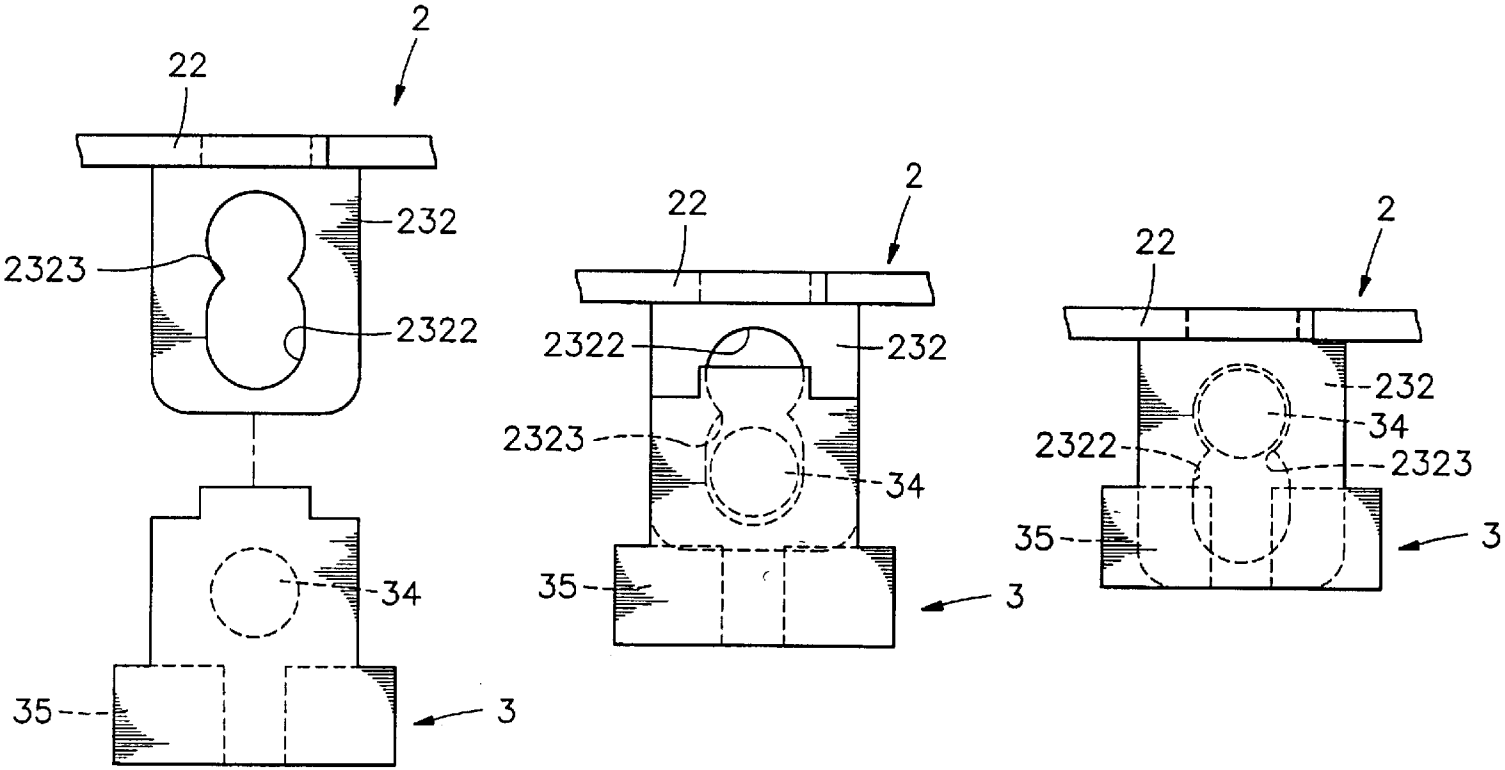
FIG. 12 is a top view showing before assembling the buckling arm and the covering element according to another preferred embodiment of the present invention.
FIG. 13 is a top view showing while assembling the buckling arm and covering element according to another preferred embodiment of the present invention.
FIG. 14 is a top view showing after assembled the buckling arm and covering element according to another preferred embodiment of the present invention.
Figure 15:
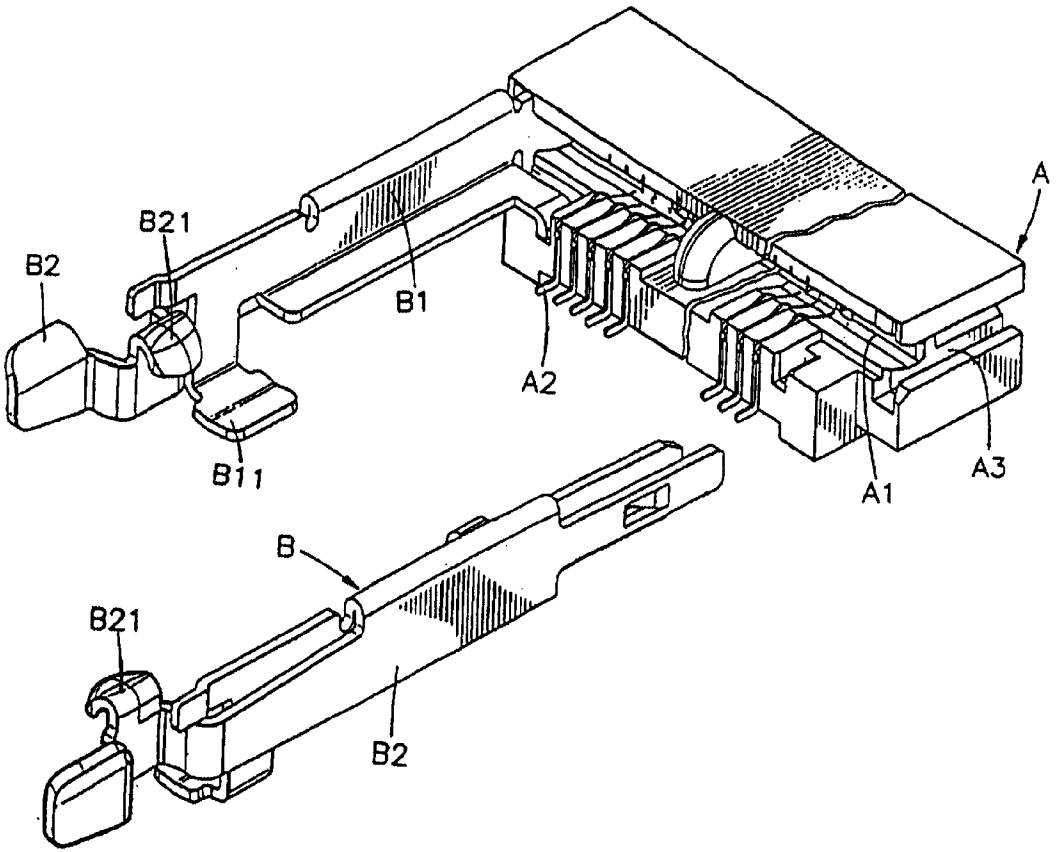
FIG. 15 PRIOR ART
FIG. 15 is an exploded view of a conventional electrical connector.

Referring to FIGS. 5, 6 and 7, the insertion portions 21 of the buckling arms 2 are inserted into the buckling grooves 121 of the socket 1 and securely positioned with the gears 211 securing the insertion portions 21 of the buckling arms 2 within the buckling grooves 121 and preventing from slipping out. The covering element 3 is engaged with the joint portion 232 of the buckling arm 2 by inserting the joint portion 232 into the fitting space 31 of covering element 3 until the edge of the joint portion 232 comes in contact and presses against the buckling hook 32 of the covering element 3 pushing the buckling hook 32 outwardly and the buckling hook 32 readily deforms due to its elastic property as the edge of the joint portion 232 passes through between the buckling hook 232, then the buckling hook 32 returns to its original shape due to its elastic nature and buckles the hook buckling groove 2321 of the joint portion 232 for substantially securing into position and form a floating adjustment space within the joint portion 232. This arrangement of the present invention allows the use of SMT to weld the plurality of signal contacts 111 of socket 1 and the bottom face of the covering element 3 onto the predetermined locations of a circuit board, because the floating adjustment space between the covering element 3 and joint portion 232 allows the buckling arm 2 to move up and down within floating adjustment space, thus the height difference between the socket 1 and buckling arm 2 due to welding can be effectively compensated.

Referring to FIGS. 1, 2, 8 and 9, a circuit board 4, for example, a memory chip module, comprises an indentation portion 41 on the two sides for engaging with the securing element 222 of the buckling arm 2. A plurality of contact elements 42 are disposed on a frontal end of the circuit board 4 wherein each of the contact elements 42 is disposed on a top side, bent to extend on a sidewall and bent to extend on a bottom side of the connecting side. The frontal end of the chip 4 is inserted into the groove 11 of the socket 1 to make an electrical contact with the row of signal contacts 111 for electronic signal transmission. The frontal end of the circuit board 4 is obliquely inserted into the groove 11 of the socket 1 so that the contact elements 42 comes in contact with the row of signal contacts 111 of the socket 1. Then, using the groove 11 as an axis, the circuit board 4 is pressed downwardly, as a result, the edge of the circuit board 4 is pressed against the arch-shaped structure of resilient arm 22 pushing the resilient arms 22 on the sides outwardly and the circuit board 4 is inserted between the side of base plate 23 and positioning element 231. The side of base plate 23 secures the circuit board 4 by pressing against the sides of the circuit board 4. This condition does not break or make the resilient arms 22 lose its elasticity, the elastic property of the resilient arms 22 allows it to be deformed and extending on the side outwardly as the circuit board 4 is pushed over the arch-shaped structure 221 enabling the pad 2221 of resilient arm 22 that is clamped around the securing clement 222 for securely buckling the intention portion 41 of the circuit board 4. In this condition, the securing clement 222 is positioned against positioning element 231 of the base plate 23, and making the contact elements 42 of the circuit board 4 to come in electrical contact with signal contacts 111 inside of groove 11 of the socket 1.

Referring to FIGS. 10, 11, 12, 13 and 14, an aperture 2322 is disposed on a surface of the joint portion 232 of buckling arm 2. A protruded buckling protrusion 2323 which extends inwardly is disposed on two sides of the aperture 2322. A guiding element 34 is disposed at a bottom surface of the covering element 3. A buckling block 35 is disposed on two sides of the frontal edge of covering element 3 forming a fitting space 31. The joint portion 232 of the buckling arm 2 is inserted into fitting space 31 to engage the guiding element 34 of the covering element 3 into the aperture 2322 of the joint portion 232 by pushing forward. In this position, the buckling protrusion 2323 of the aperture 2322 surrounds the guiding element 34 of the covering element 3. Meanwhile the joint portion 232 fits into the fitting space 31 within the inner surface of the buckling blocks 35 of the covering element 3. Thus, the covering element 3 is securely engaged with the joint portion 232 of the buckling arm 2 and form a floating adjustment space between the covering element 3 and the joint portion 232. This arrangement of the present invention allows the use of SMT to weld the plurality of signal contacts 111 of socket 1 and the bottom face of the covering element 3 onto the predetermined locations of a circuit board, because the floating adjustment space between the covering element 3 and joint portion 232 allows the buckling arm 2 to move up and down within floating adjustment space, thus the height difference between the socket 1 and buckling arm 2 due to welding can be effectively compensated.

The electrical connector for attaching to a circuit board of the present invention has the following advantages and features compared to the conventional circuit board connector:

(1) By engaging the covering element 3 with the joint portion 232 of the buckling arm 2, a space for floating adjustment is formed between the covering element 3 and joint portion 232. The floating adjustment space between the covering element 3 and joint portion 232 allows the buckling arm 2 to move up and down within floating adjustment space, thus the height difference between the socket 1 and buckling arm 2 due to welding can be effectively compensated. Thus reliable electrical connections between the electrical connector 1 and the circuit board 4 can be achieved.

(2) The structure of the covering element 3 and the joint portion 232 of the buckling arm 2 allows to insert the joint portion 232 into fitting space 31 of the covering element 3 for securely buckling the buckling hook 32 of the covering element 3 in the hook buckling groove 2321 of the joint portion 232 and effectively prevent the covering element 3 from slipping out.

(3) The buckling protrusion 2323 of the aperture 2322 surrounds the guiding element 34 of the covering element 3. Meanwhile the joint portion 232 fits into the fitting space 31 within the inner surface of the buckling blocks 35 of the covering element 3. Thus, the covering element 3 is securely engaged with the joint portion 232 of the buckling arm 2 and forms a floating adjustment space between the covering element 3 and the joint portion 232. This arrangement of the present invention allows the use of SMT to weld the plurality of signal contacts 111 of socket 1 and the bottom face of the covering element 3 onto the predetermined locations of a circuit board 4, because the floating adjustment space between the covering element 3 and joint portion 232 allows the buckling arm 2 to move up and down within floating adjustment space, thus the height difference between the socket 1 and buckling arm 2 due to welding can be effectively compensated.

(4) The space between the side of base plate 23 and positioning element 231 allows the side of base plate 23 flexibly extend on the side outwardly without the risk of breaking or loss of elasticity when the circuit board 4 is pressed in between the resilient arms 22.

(5) The space between the side of base plate 23 and positioning element 231 allows the side of base plate 23 flexibly extend on the side outwardly without the risk of breaking or loss of elasticity and allows the pad 2221 of resilient arm 22 that is clamped around the securing element 222 to buckle the intention portion 31 of the circuit board 4, and the securing element 222 can be against the positioning element 231 of the base plate 23, to substantially secure the circuit board 4 and preventing the circuit board 4 from coming loose.

While the invention has been described in conjunction with a specific best mode, it is to be understood that many alternatives, modifications, and variations will be apparent to those skilled in the art in light of the a foregoing description. Accordingly, it is intended to embrace all such alternatives, modifications, and variations, which fall within the spirit and scope of the included claims. All matters set forth herein or shown in the accompanying drawings are to be interpreted in an illustrative and non-limiting sense.

What the invention claimed is:

1. An electrical connector for attaching to a circuit board, comprising:

a socket, comprising a groove, a row of signal contacts disposed within the groove, and a buckling element disposed on two ends of the socket; and two buckling arms with each detachably engaged into each buckling groove of the socket, each comprising a resilient arm, deformed toward each other and having a securing element extending downwardly, a base plate having a positioning plate for folding said securing element of said resilient arm, and a joint portion, wherein the joint portion is disposed at a bottom edge of the base plate; and a covering element comprising a fitting space for covering and securely engaging with the joint portion, wherein a gap is formed between an inner surface of the covering element and the joint portion in engagement position which allows the covering elements to move up and down within said fitting space, for welding the bottom faces of the covering elements onto the predetermined locations.

2. The electrical connector of claim 1, wherein the buckling element of the socket comprising a buckling groove for receiving an insertion portion of the buckling arm for detachably engaging and securing the buckling arm to the socket.

3. The electrical connector of claim 1, wherein a bottom edge of the insertion portion of buckling arm comprises a plurality of gears for securely attaching the buckling arm within the buckling groove of the socket.

4. The electrical connector of claim 1, wherein each resilient arm of said buckling arm comprising an arch-shaped structure, wherein the securing element is disposed at a distal end of each resilient arm, wherein a positioning element is disposed correspondingly at a rear side of each base plate rendering the resilient arms elastic so that resilient arms can elastically deform in an inward and outward direction between the base plate, and wherein a circuit board can be securely buckled to the securing elements in between the resilient arms, the positioning element positions the circuit board in the groove of the socket as the circuit board is inserted into the groove of the socket and pressed downwardly against the arch-shaped structure.

5. The electrical connector of claim 4, wherein the arch-shaped structure of buckling element serve for biasing inwardly.

6. The electrical connector of claim 1, wherein each resilient arm has an arch-shaped structure.

7. The electrical connector of claim 7, wherein the joint portion of said buckling arm comprises indented buckling grooves on two sides, and wherein the covering element comprises buckling hooks on two opposite sides for fixing the joint portion into the fitting space of said covering element, and the buckling hook of the covering element is for buckling with the buckling grooves of the joint portion.

8. The electrical connector of claim 7, wherein the covering element comprises a through hole on a bottom surface.

9. The electrical connector of claim 1, wherein the joint portion of said buckling arm comprise an aperture, and said aperture comprises a buckling protrusion, wherein the covering element comprises a guiding element at a bottom edge, and bent buckling blocks on a frontal side, said guiding element can slide into said aperture of the joint portion allowing the guiding element of the covering element to engage into the aperture and buckle with the buckling protrusion of said aperture for securely fixing with the joint portion, and wherein a gap is formed between an inner surface of the covering element and the joint portion in engagement position which allows the buckling arms to move up and down within said fitting space.

10. The electrical connector of claim 1, wherein the joint portion of said base plate is formed bent inwardly.

11. The electrical connector of claim 1, wherein the socket is constructed from an insulated material.

12. The electrical connector of claim 1, wherein the buckling arms are constructed from a conductive material.

13. The electrical connector of claim 1, wherein the covering element is constructed from a conductive material.

* * * * *